US007533608B2

(12) United States Patent
Schneider et al.

(10) Patent No.: US 7,533,608 B2
(45) Date of Patent: May 19, 2009

(54) PRINTING BLANKET HAVING A DIMENSIONALLY STABLE CARRIER PLATE, A METHOD FOR PRODUCING A PRINTING BLANKET OF THIS TYPE, AND A PRINTING UNIT FOR A PRINTING MACHINE WITHOUT A DAMPING UNIT

(75) Inventors: Georg Schneider, Würzburg (DE); Wolfgang Otto Reder, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 284 days.

(21) Appl. No.: 10/582,606

(22) PCT Filed: Dec. 14, 2004

(86) PCT No.: PCT/EP2004/053457

§ 371 (c)(1),
(2), (4) Date: Jun. 12, 2006

(87) PCT Pub. No.: WO2005/058601

PCT Pub. Date: Jun. 30, 2005

(65) Prior Publication Data

US 2007/0144380 A1 Jun. 28, 2007

(30) Foreign Application Priority Data

Dec. 16, 2003 (DE) ..... 103 58 842
Mar. 11, 2004 (DE) ..... 10 2004 011 882
May 7, 2004 (DE) ..... 10 2004 023 316

(51) Int. Cl.
*B41F 13/10* (2006.01)
*B41F 27/06* (2006.01)
*B41G 7/00* (2006.01)
*B41L 47/02* (2006.01)
*B41F 7/02* (2006.01)

(52) U.S. Cl. ..... 101/376; 101/368; 101/217

(58) Field of Classification Search ..... 101/217, 101/368, 375, 376
See application file for complete search history.

(56) References Cited

U.S. PATENT DOCUMENTS 5,351,615 A 10/1994 Kobler et al.
6,408,747 B2 * 6/2002 Koppelkamm et al. ..... 101/147
6,920,824 B2 * 7/2005 Holm ..... 101/217
7,004,070 B2 2/2006 Schneider et al.
7,021,215 B2 4/2006 Schneider et al.
7,066,090 B2 6/2006 Holm
7,246,557 B2 7/2007 Holm (Continued)

FOREIGN PATENT DOCUMENTS

DE 1 947 520 10/1966

(Continued)

*Primary Examiner*—Anthony H. Nguyen
*Assistant Examiner*—Leo T Hinze
(74) *Attorney, Agent, or Firm*—Jones, Tullar & Cooper, P.C.

(57) ABSTRACT

A printing blanket or dressing includes a dimensionally stable carrier plate which has ends that can be secured to a transfer cylinder. A coating is applied to the carrier plate and forms the lateral surface of the transfer cylinder. A recess is located in the printing blanket or dressing intermediate the ends of the blanket or dressing.

30 Claims, 14 Drawing Sheets

U.S. PATENT DOCUMENTS

| | | | |
|---|---|---|---|
| 2005/0274273 | A1 | 12/2005 | Schneider et al. |
| 2006/0000380 | A1 | 1/2006 | Schneider et al. |

FOREIGN PATENT DOCUMENTS

| | | | |
|---|---|---|---|
| DE | 25 28 008 | | 1/1976 |
| DE | 33 15 506 | A1 | 10/1984 |
| DE | 3441 175 | A1 | 5/1986 |
| DE | 44 00 020 | A1 | 8/1995 |
| DE | 198 02 470 | A1 | 7/1999 |
| DE | 102 18 359 | A1 | 11/2003 |
| DE | 200 23 299 | U1 | 11/2003 |
| EP | 0 182 156 | B1 | 4/1991 |
| GB | 1 476 707 | | 6/1977 |
| WO | WO 0139977 | A1 * | 6/2001 |
| WO | WO 03/045695 | | 11/2002 |

* cited by examiner

PRINTING BLANKET HAVING A DIMENSIONALLY STABLE CARRIER PLATE, A METHOD FOR PRODUCING A PRINTING BLANKET OF THIS TYPE, AND A PRINTING UNIT FOR A PRINTING MACHINE WITHOUT A DAMPING UNIT

CROSS REFERENCE TO RELATED APPLICATIONS

This patent application is the U.S. National Phase, under 35 USC 371, of PCT/EP2004/053457, filed Dec. 14, 2004; published as WO 2005/058601 A2 on Jun. 30, 2005 and claiming priority to DE 103 58 842.6, filed Dec. 16, 2003; to DE 10 2004 011 882.5, filed Mar. 11, 2004; and to DE 10 2004 023 316.0 filed May 7, 2004, the disclosures of which are expressly incorporated herein by reference.

FIELD OF THE INVENTION

The present invention is directed to a printing blanket having a dimensionally-stable support plate, to a method for producing such a printing blanket, as well as to a printing group for a printing press without a dampening unit. The printing blanket and the support plate constitute a printing blanket unit. The support plate is made of metal.

BACKGROUND OF THE INVENTION

Some printing groups operate without the use of dampening agents and are thus particularly suited to waterless web offset printing. When printing is being done, without the use of dampening agents, a printing plate which permits the transfer of the print image, without the use of dampening agents, is fastened to a plate cylinder of the printing group. The printing plate has a lower layer of an ink-absorbing material and an upper layer of an ink-repelling material. Ink-repelling at the upper layer of the printing plate takes place without dampening agents. Accordingly, special materials are required for use in producing the upper plate layer. Silicon-containing materials, in particular, have shown themselves to be suitable for use as an ink-repelling layer without the use of dampening agents.

The upper, and therefore the ink-repellent layer of the printing plate has openings in that layer with those openings being situated in the areas of the print image which are to be printed. The printing ink can thus collect on the ink-absorbing layer which is located underneath the ink-repellant layer. In printing groups of this type, the print image can be transferred, in this way, to a downstream-located transfer cylinder, such as, for example, a rubber blanket cylinder. The upper layer of the printing plate covers the lower layer in the areas of the print image which are not to be printed, so that no printing ink is transferred in these areas.

A printing group for waterless offset printing is described in WO 03/045695 A1, for example.

EP 0 182 156 B1 discloses a rubber blanket cylinder with an area whose radius has been reduced.

A rubber blanket whose ends taper is known from DE 198 02 470 A1.

DE 198 02 470 A1 discloses a multi-layered rubber blanket.

DE 33 15 506 A1 describes an offset blanket having a recess extending along an axial direction between its ends. This is provided in order to prevent plate edges from also being printed.

If several printing plates are fastened on the plate cylinder one behind the other, with their ends facing each other, the problem arises, in connection with planographic printing without the use of a dampening agent, that the ends of the printing plates are often also being printed, at least lightly. This occurs even though the ends of the printing plates are located in an area of the print image which actually should not be printed.

SUMMARY OF THE INVENTION

The object of the present invention is directed to providing a printing blanket with a dimensionally-stable support plate, to a method for producing such a printing blanket, as well as to a printing group for use with a printing press without a dampening unit.

In accordance with the present invention, this object is attained by the provision of a printing blanket that includes a dimensionally stable support plate and having a coating which constitutes a shell face of a transfer cylinder to which the blanket can be fixed. The printing blanket and the support plate constitute a printing blanket unit. The support plate is made of metal which has an area of deformation or of reduced thickness intermediate its ends. This results in a depression which is arranged between the ends of the printing blanket. The deformation of the support plate can be accomplished using dies and can be done after the printing blanket has been applied.

A particular advantage of the printing group in accordance with the present invention lies in that depressions on the shell face of the transfer cylinder are placed opposite the ends of the printing plates and extend parallel with the longitudinal axis of the transfer cylinder. Ink transfer from the ends of the printing plates to the transfer cylinder is prevented in this way. As a result, the ends of the printing plates are thus not imprinted, even in connection with planographic printing without the use of dampening agents. This is because an ink transfer to this area is not possible because of the depressions in the transfer cylinder.

The specific way in which the transfer cylinder is structurally configured is basically open to choice. In accordance with a preferred embodiment of the present invention, the transfer cylinder has a printing blanket including a dimensionally-stable support plate, and with a coating that is fixed on the support plate. The ends of the support plate can be fixed in place on the transfer cylinder, for fastening the printing blanket in place. The shell face of the transfer cylinder is constituted by the outside of the coating which is carried by the printing blanket.

A depression in the surface of the transfer cylinder can be constituted by a spacing between the leading end and the trailing end of the printing blanket, and in particular, by a distance between a leading lateral or transverse edge and a trailing lateral or transverse edge of the coating of the printing blanket.

In addition, the coating of the printing blanket can have a groove that is worked into, or formed in the coating of the printing blanket and which is located between the leading end and the trailing end of the printing blanket, and in particular is located between the leading lateral or transverse edge and the trailing lateral edge of the coating of the printing blanket, and which, in particular, is centered approximately between these two lateral or transverse edges. The depth of the groove should preferably correspond to from 5% to 15% of the thickness of the coating.

As an alternative to the use of a printing blanket with a support plate, printing blankets, whose actual ends are fixed on the transfer cylinder, are also within the scope of the present invention. With such printing blankets, a depression can be formed by use of the distance between the leading and the trailing suspension edges of the printing blanket. It is also possible to work a groove into the printing blanket for use in forming the depression. If an underlayer is provided between the printing blanket and the transfer cylinder, the underlayer can have at least one break, or a reduction of its cross section to form the depression on the outer circumference of the printing blanket.

The width of the depression, in the circumferential direction of the cylinder, should approximately correspond to from 0.1% to 1% of the length of the printing blanket in the circumferential direction.

It is of particular advantage if the plate cylinder and/or the transfer cylinder can be temperature-controlled. The ink transfer process of the ink, which is free of the dampening agent can be better controlled by the use of the temperature control.

BRIEF DESCRIPTION OF THE DRAWINGS

The present invention will be explained by way of example in what follows by the use of the embodiments represented in the drawings.

Shown are in.

DESCRIPTION OF THE PREFERRED EMBODIMENTS

Figure 1:
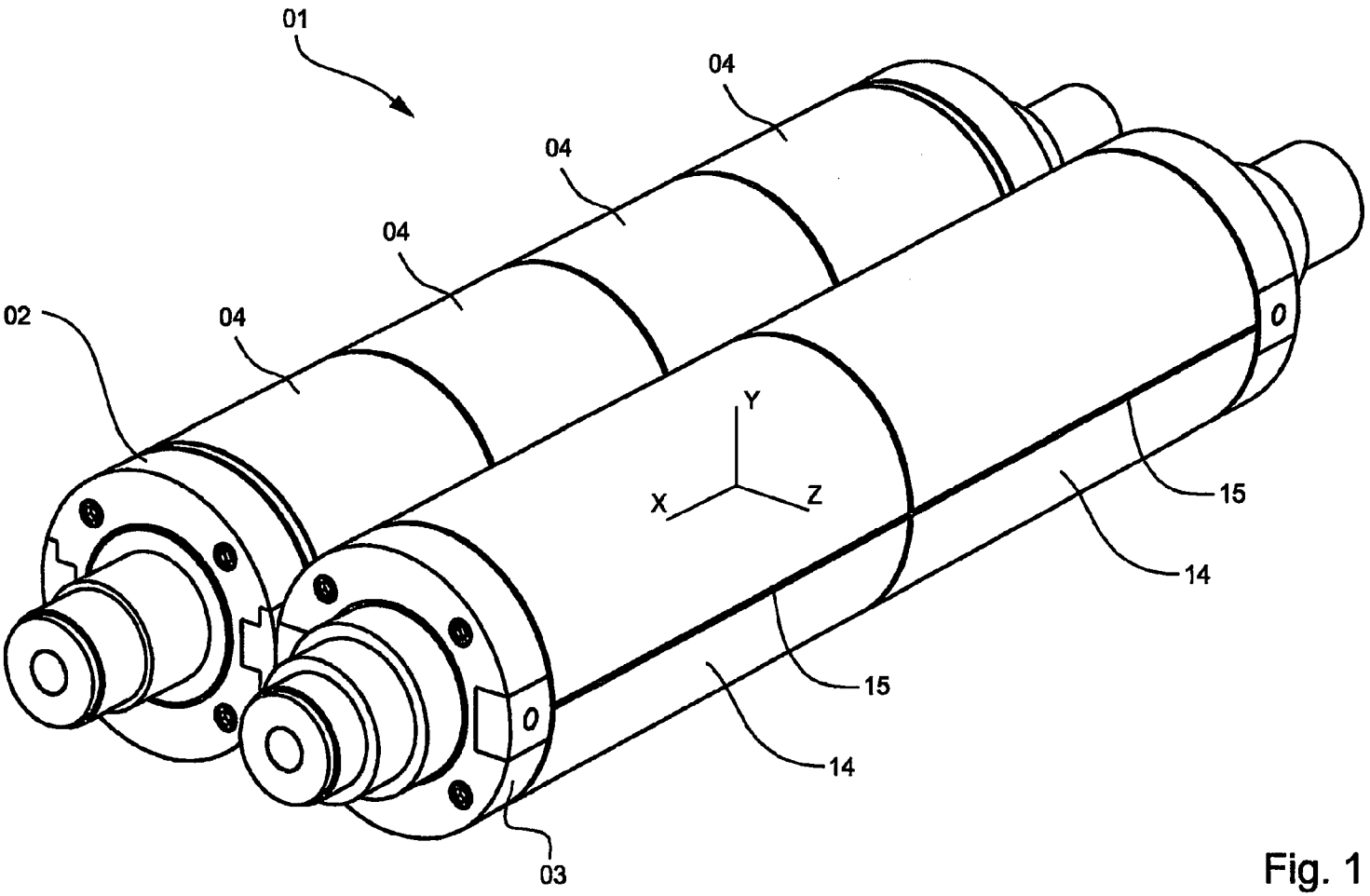
FIG. 1, a perspective view of a plate cylinder and a transfer cylinder of a printing group operated without a dampening agent in accordance with the present invention, in FIGS. 2*a*-2*e*, schematic depictions of five processing steps for producing the ink-transferring printing plates of the printing group in accordance with FIG. 1, in FIG. 3, a cross-sectional view of the printing group in accordance with FIG. 1, in FIG. 4, an enlarged portion of the cross section of the encircled portion of printing group, as indicated at A in FIG. 3, in FIG. 5, a top plan view of a printing blanket of the transfer cylinder in accordance with FIG. 1, in FIG. 6, a side elevation view of the printing blanket in accordance with FIG. 5, in FIG. 7, a side elevation view of a second embodiment of a transfer cylinder with a second embodiment of a printing blanket, in FIG. 8, a front elevation view of another preferred embodiment of the printing blanket of the transfer cylinder, in FIG. 9, the printing blanket in accordance with FIG. 8 in a cross-sectional view similar to FIG. 4, in FIG. 10, a side elevation view of an enlarged portion of a depression in the printing blanket, in FIG. 11, a further preferred embodiment of the present invention, and in FIGS. 12 to 14, schematic depictions of process steps for producing a printing blanket unit in accordance with the present invention.

A portion of a printing group 01 of a printing press, and including a plate cylinder 02 and a transfer cylinder 03, which is placed against the plate cylinder 02, is shown in a perspective view in FIG. 1. Two printing plates 04, and in particular two planographic printing plates 04, have been fastened, one behind the other in a circumferential direction of plate cylinder 02, to a circumference of the plate cylinder 02. These printing plates 04 are arranged axially side-by-side in four rows, so that a total number of eight printing plates 04 are positioned on the circumference of plate cylinder 02 as seen in FIG. 1. The printing plates 04 transfer a desired print image, by planographic printing, and without a dampening agent, to a circumferential face of the transfer cylinder 03, from where the print image is transferred, such as, for example, to a web of material to be imprinted, by offset printing.

The production of a circumferential layer on the several printing plates 04, which transfers the ink to the transfer cylinder 03, will be briefly explained in the discussion which follows, and by reference to the five drawings in FIGS. 2*a*-2*e* which, by way of example, represent the several individual steps for producing a printing plate 04, which is operating without dampening agent.

Figure 2:
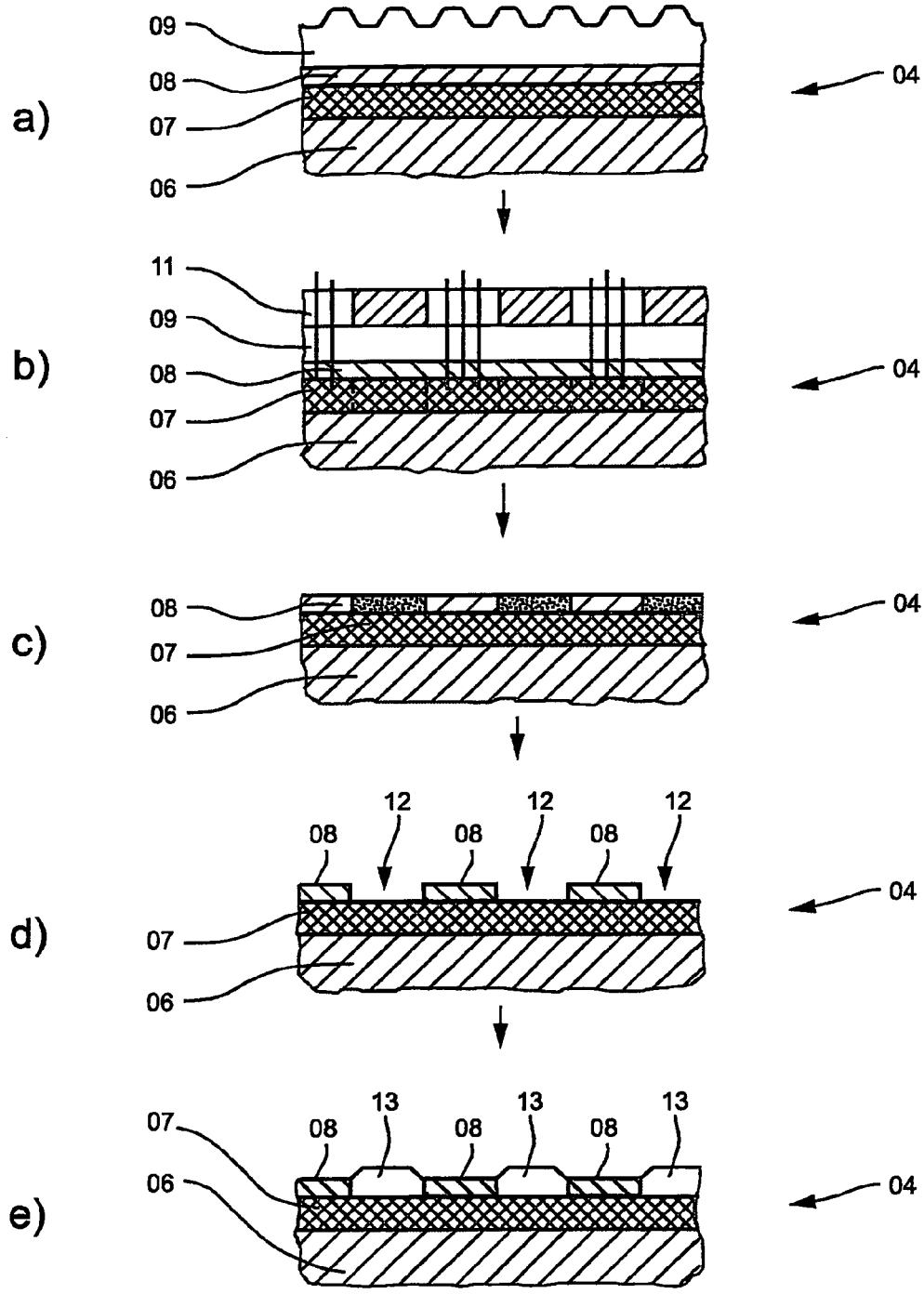

As can be seen from FIG. 2*a*, the printing plate, generally at 04, is constructed using a support layer 06, such as, for example, of aluminum, an ink transfer layer 07, which is made of an ink transfer material, an ink-repelling layer 08, which is made of an ink-repelling material, such as, for example, silicon, and a protective layer 09. To transfer a desired print image to the printing plate 04, the printing plate 04 is exposed with the use of a positive film 11, for example, containing the print image, as depicted schematically in FIG. 2*b*. UV light, in particular, can be used for the exposure process. The ink-repelling layer 08 is detached in a locally limited manner at the exposed locations of the printing plate 04, as shown in FIG. 2*c* and can be removed in sections by the use of suitable solvents. As a result, the remaining ink-repelling layer 08 now covers the ink transfer layer 07 only at the places of the print image which are not intended to be imprinted later, as depicted in FIG. 2*d*. The ink-repelling layer 08 has openings 12 exposing the ink transfer layer 07 at the places of the print image which are to be printed. In the course of a printing process, ink 13 can be deposited on the ink accepting ink transfer layer 07 in the area of the openings 12, as seen in FIG. 2*e*, and can, in this way, be transferred to the downstream-connected transfer cylinder 03. As a result, a transfer of the ink 13, which is free of dampening agent, is possible. Of course, other manufacturing processes for producing printing plates, which are capable of operating without dampening agents, are also known and usable.

Figure 3:
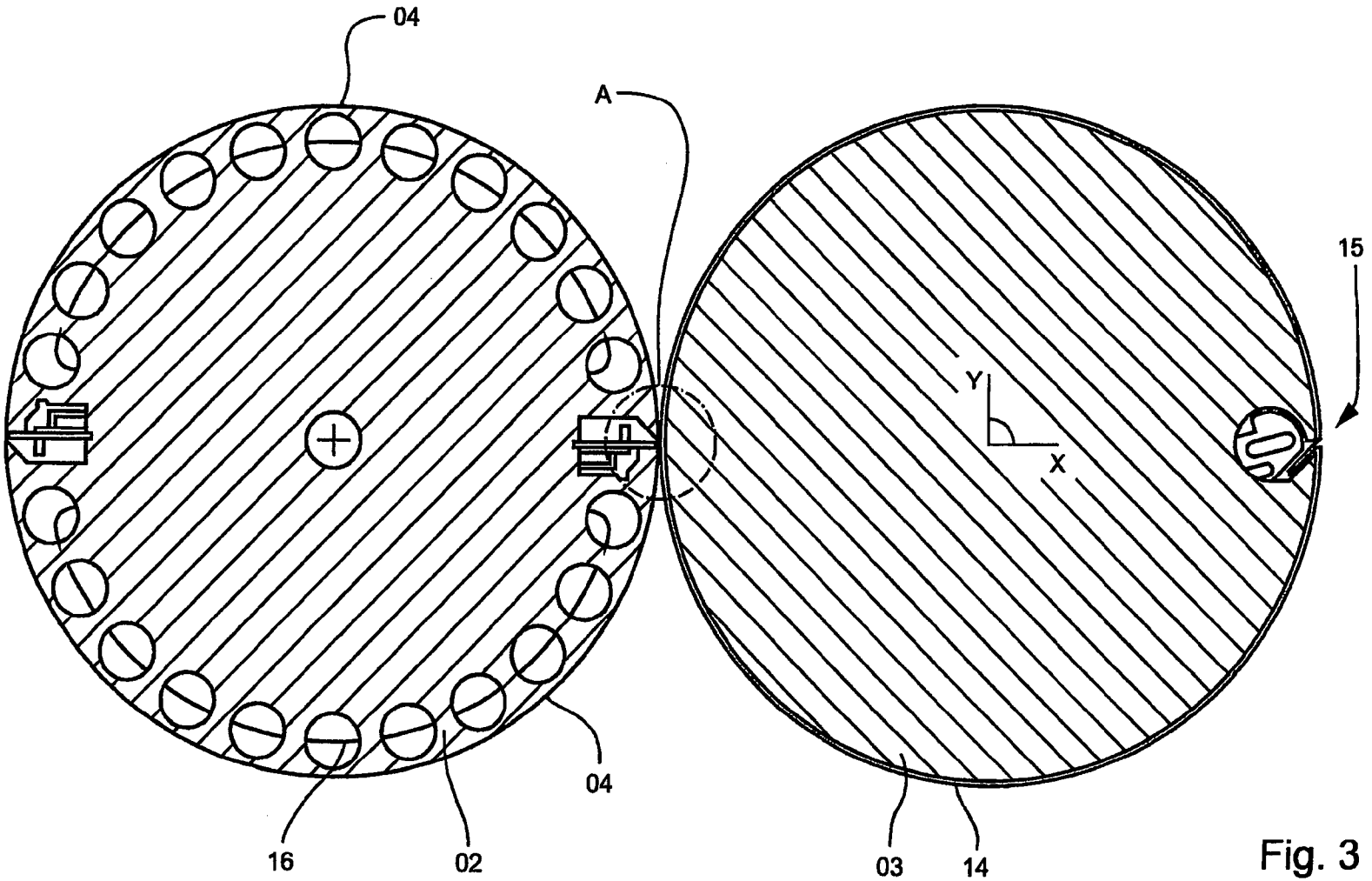

As can be seen in the cross section which is represented in FIG. 3, a printing blanket 14 has been clamped over the circumference of the transfer cylinder 03. A depression 15 in the circumferential surface of the transfer cylinder 03 is formed by the spacing between the leading end and the trailing end of the printing blanket 14.

The plate cylinder 02 has conduits 16, through which a temperature-controlled fluid can flow, to control the temperature of the plate cylinder 02 from the inside. The contact zone between the plate cylinder 02 and the transfer cylinder 03, in which contact zone the printing plates 04, which are arranged one behind the other, come into contact with the printing blanket 14, for the purpose of transferring ink from the printing plates 04 to the printing blanket 14, is represented in an enlarged view in FIG. 4.

Figure 4:
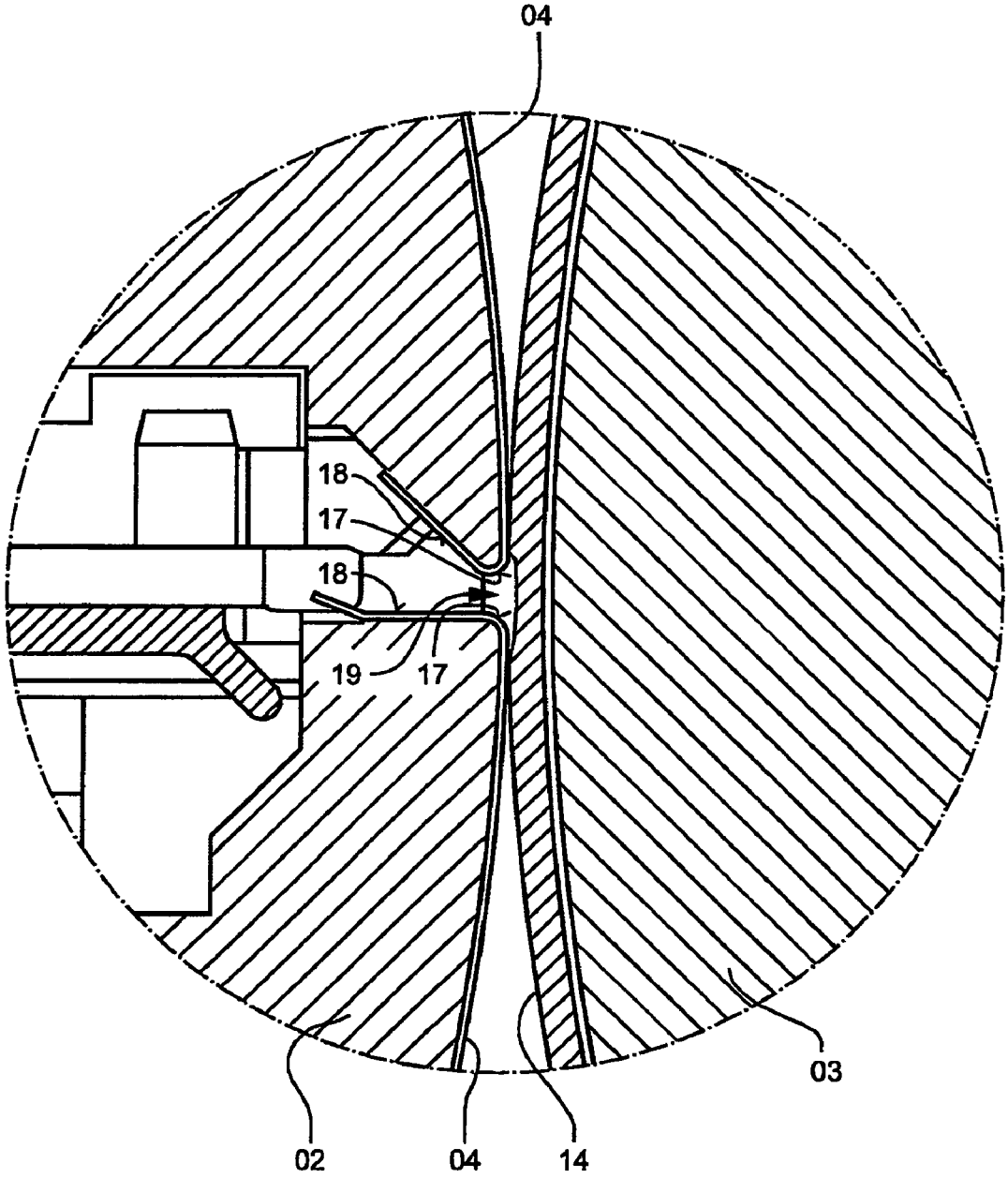

As can be seen in from FIG. 4, the printing plates 04, which are arranged one behind the other on the plate cylinder 02, are each fixed in place on the plate cylinder 02 by fastening strips 18. In an area of the circumference of the transfer cylinder 03, on which ends 17 of the printing plates 04 roll off, the printing blanket 14 has a surface depression 19, so that no ink is transferred to the printing blanket 14 in the area of the ends 17 of the printing plates 04 that are secured on the plate cylinder 02.

Figure 5:
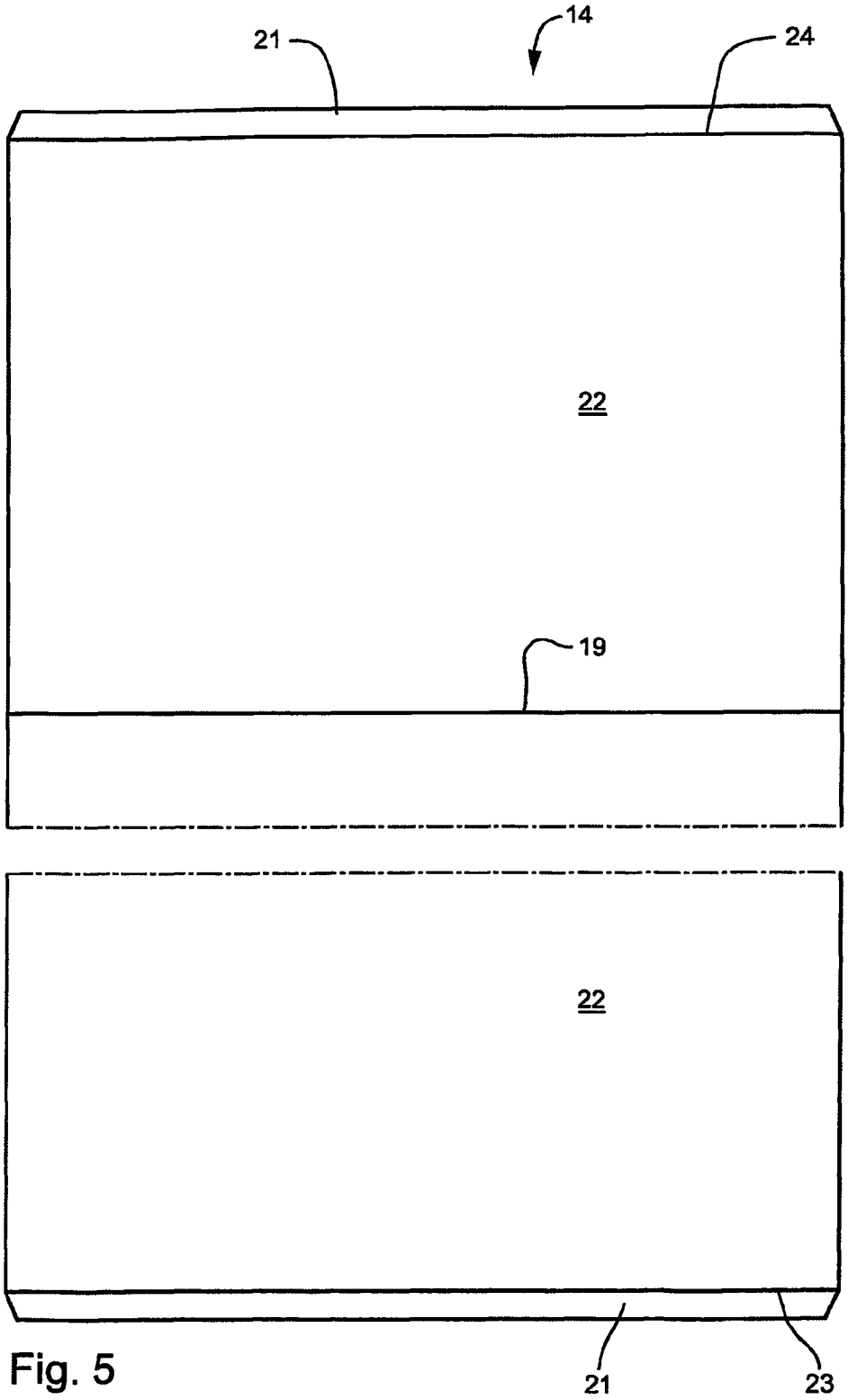
Figure 6:
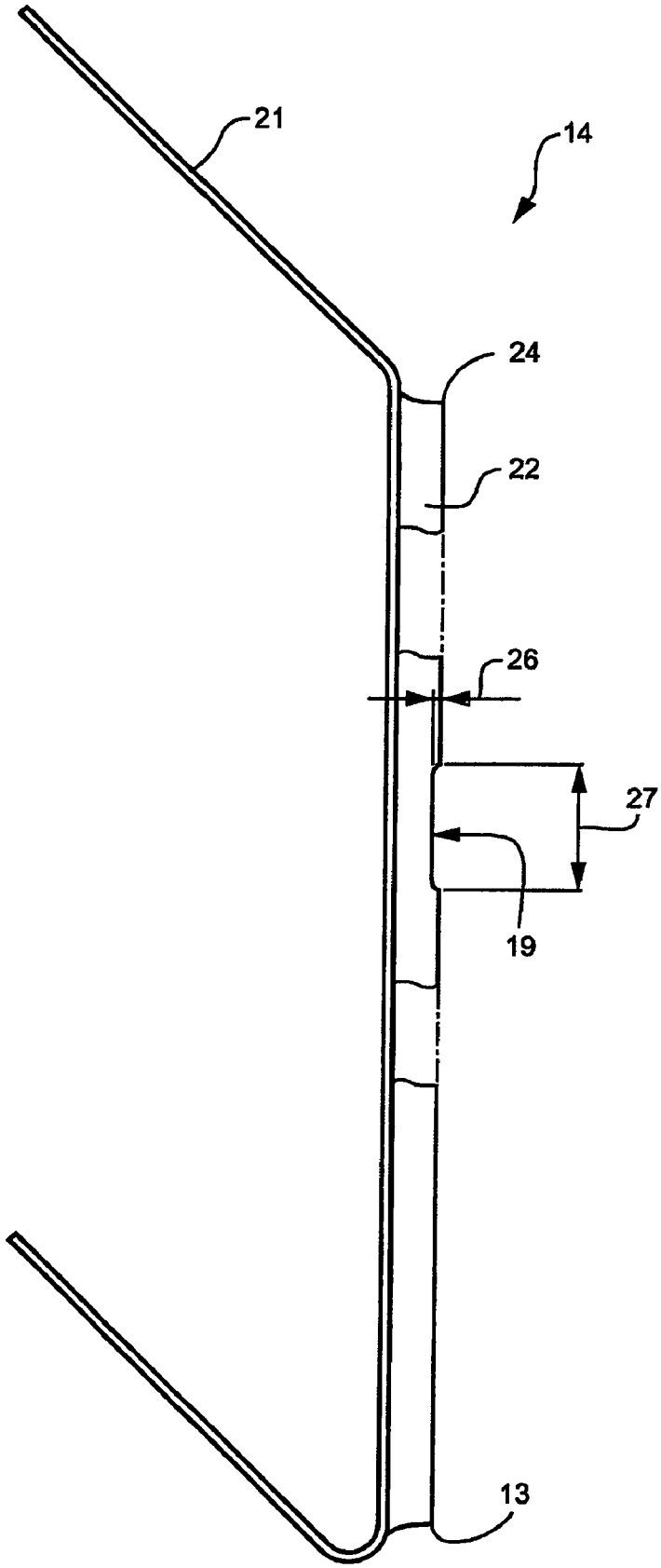

The structure of a printing blanket 14 is represented in FIG. 5 and FIG. 6. This printing blanket 14 would preferably be employed in a printing unit such as is described in DE 103 11 285 A or in DE 198 03 809 A. A multi-layered coating 22, which is typically made of rubber, has been vulcanized onto a dimensionally-stable support plate 21, which is typically made of special steel. The surface depression 19 is constituted by an axially extending groove which is arranged approximately centered between the leading lateral blanket edge 23 and the trailing lateral blanket edge 24 of the coating 22. A depth 26 of the depression 19 is approximately 10% of a thickness of the coating 22. A width 27 of the depression 19 is approximately 0.5% of an effective length of the printing blanket 14 which effective length, in the present embodiment, corresponds to a length of the coating 22 on the printing blanket 14 in the circumferential direction of the transfer cylinder 03.

Figure 7:
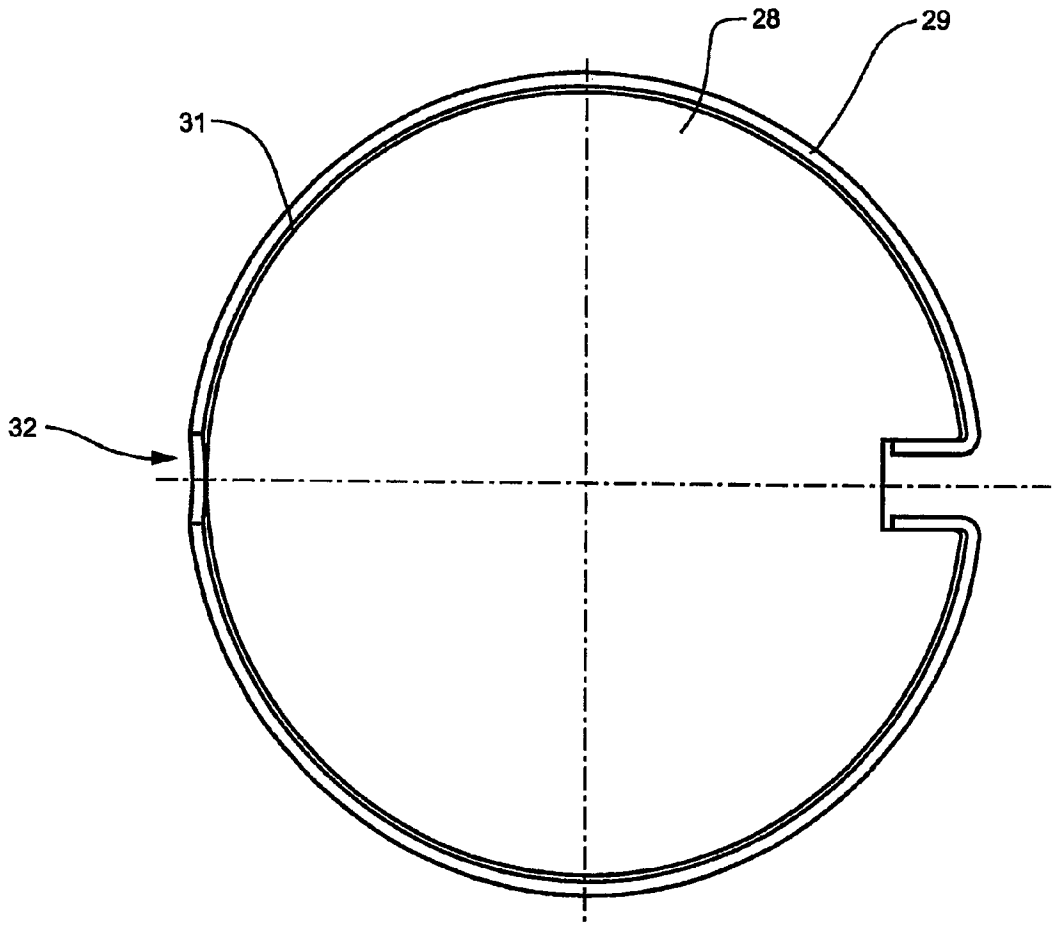

A second embodiment of a transfer cylinder 28, with a printing blanket 29 fastened on it, is represented in cross section in FIG. 7. Ends of the printing blanket 29 are fastened in a groove on the transfer cylinder 28. An underlayer 31 is arranged between the outer circumference of the transfer cylinder 28 and the inner circumference of the printing blanket 29. In an area of the outer circumference of the transfer cylinder 28 and the inner circumference of the blanket 29, located opposite the fastening groove for fixing the ends of the printing blanket 29 in place, the underlayer 31 has a break, so that a depression 32 is formed, in this way, at the outer circumference of the printing blanket 29.

In place of providing the underlayer 31 with the break, the shell face of the transfer cylinder 28 can have a break.

Figure 8:
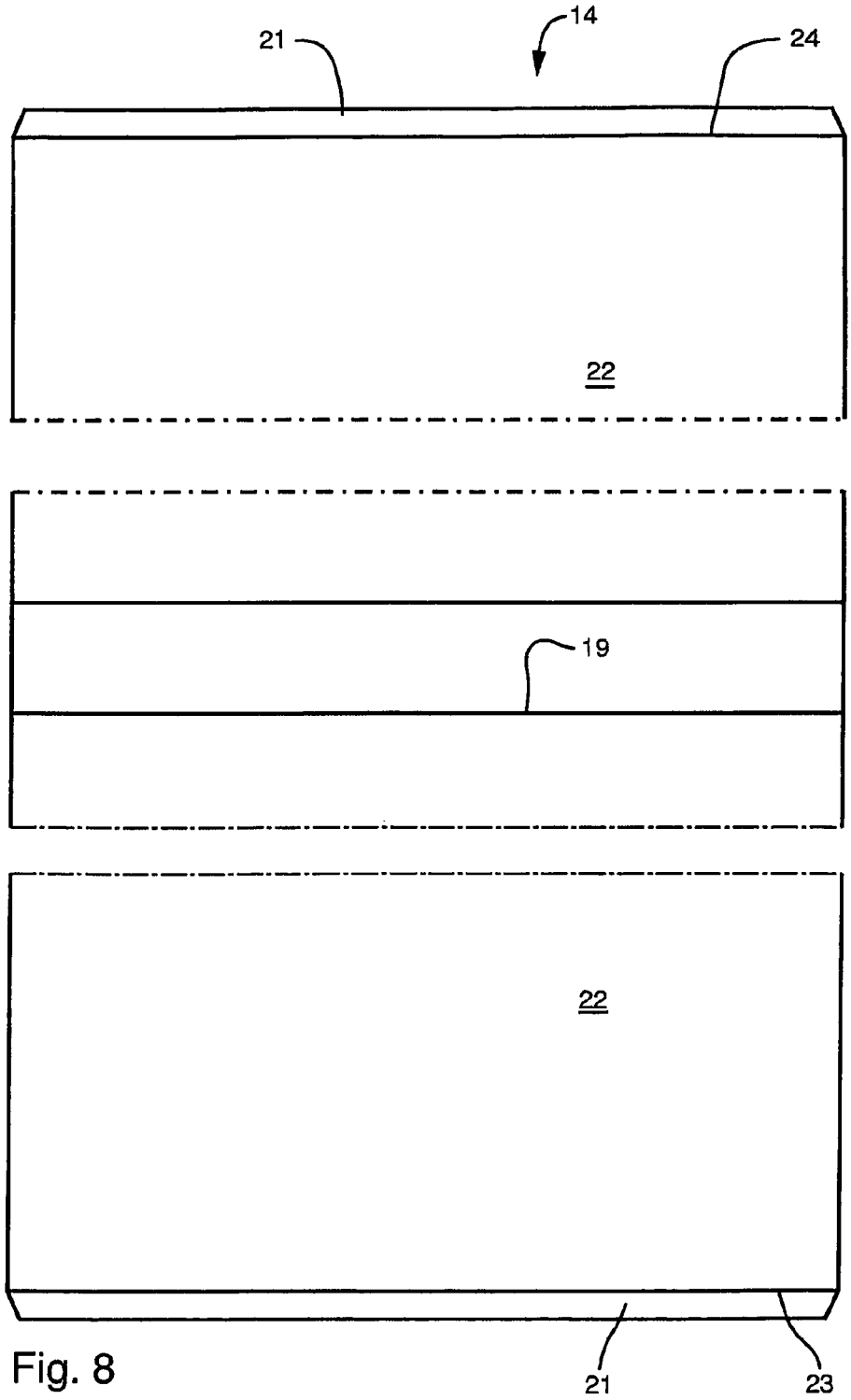
Figure 9:
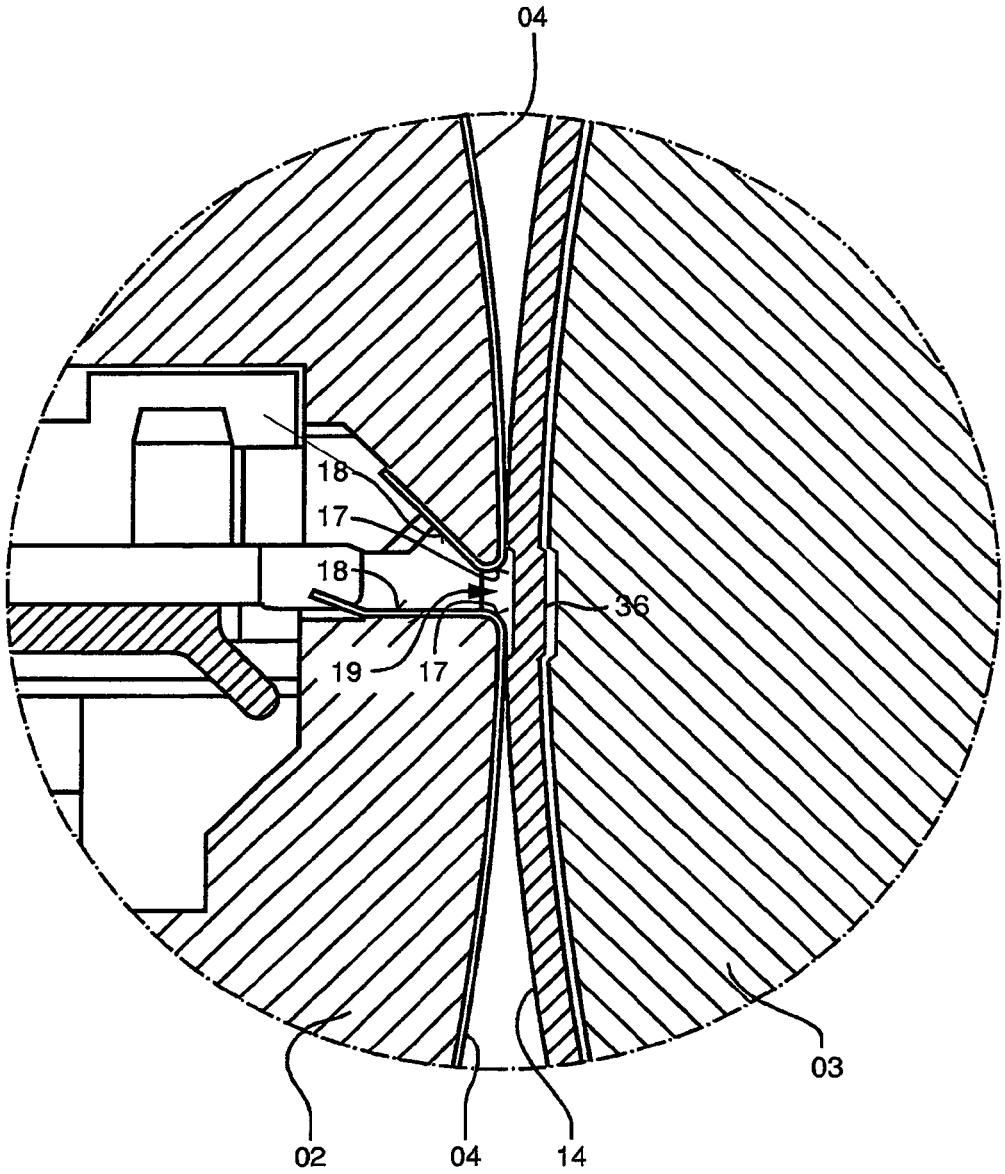

In a further preferred embodiment of the present invention, and as depicted in FIGS. 8 and 9, a depression 19 has been formed as a result of a deformation cut into, or formed in the support plate 21 of the printing blanket 14, i.e. at the location in which the depression 19 has been formed in the support plate 21. The depression 19 is a dimensionally-stable deformation.

Figure 12:
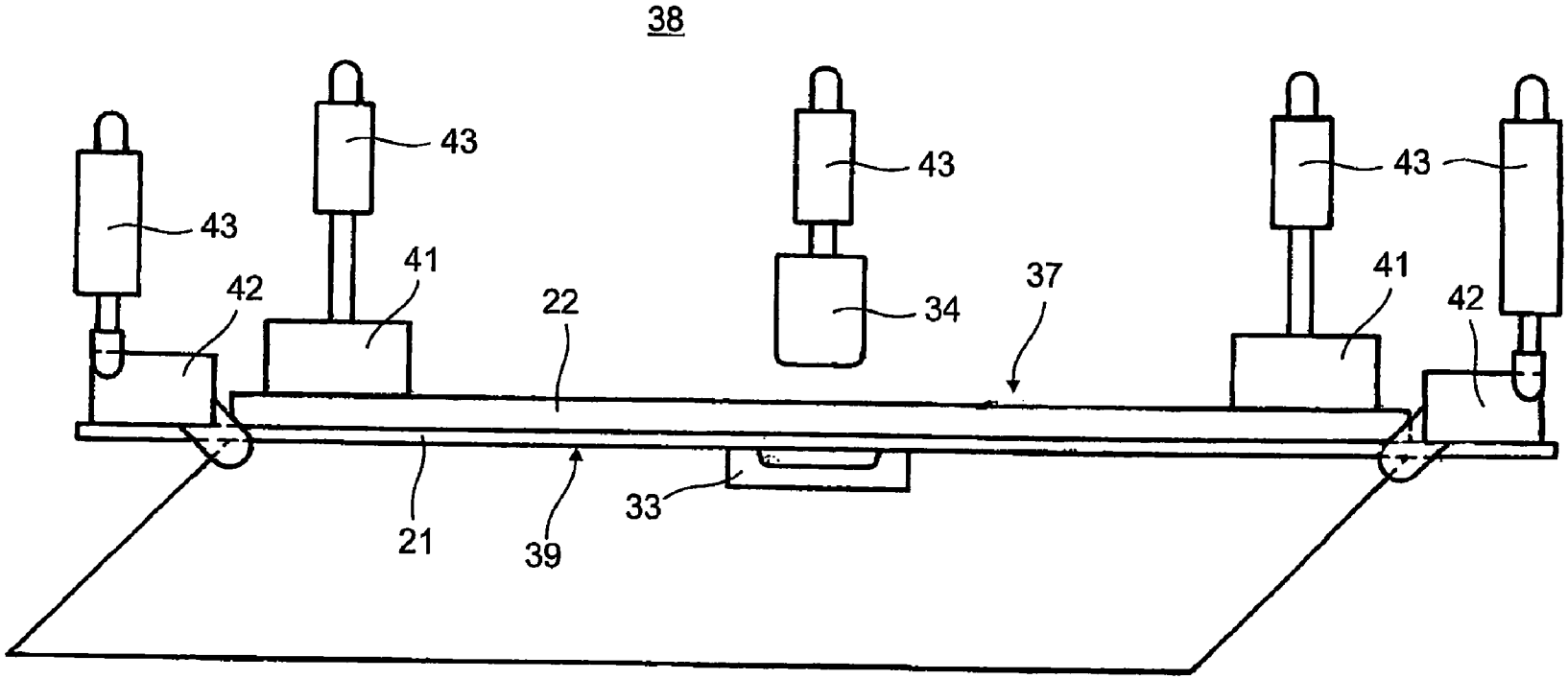
Figure 13:
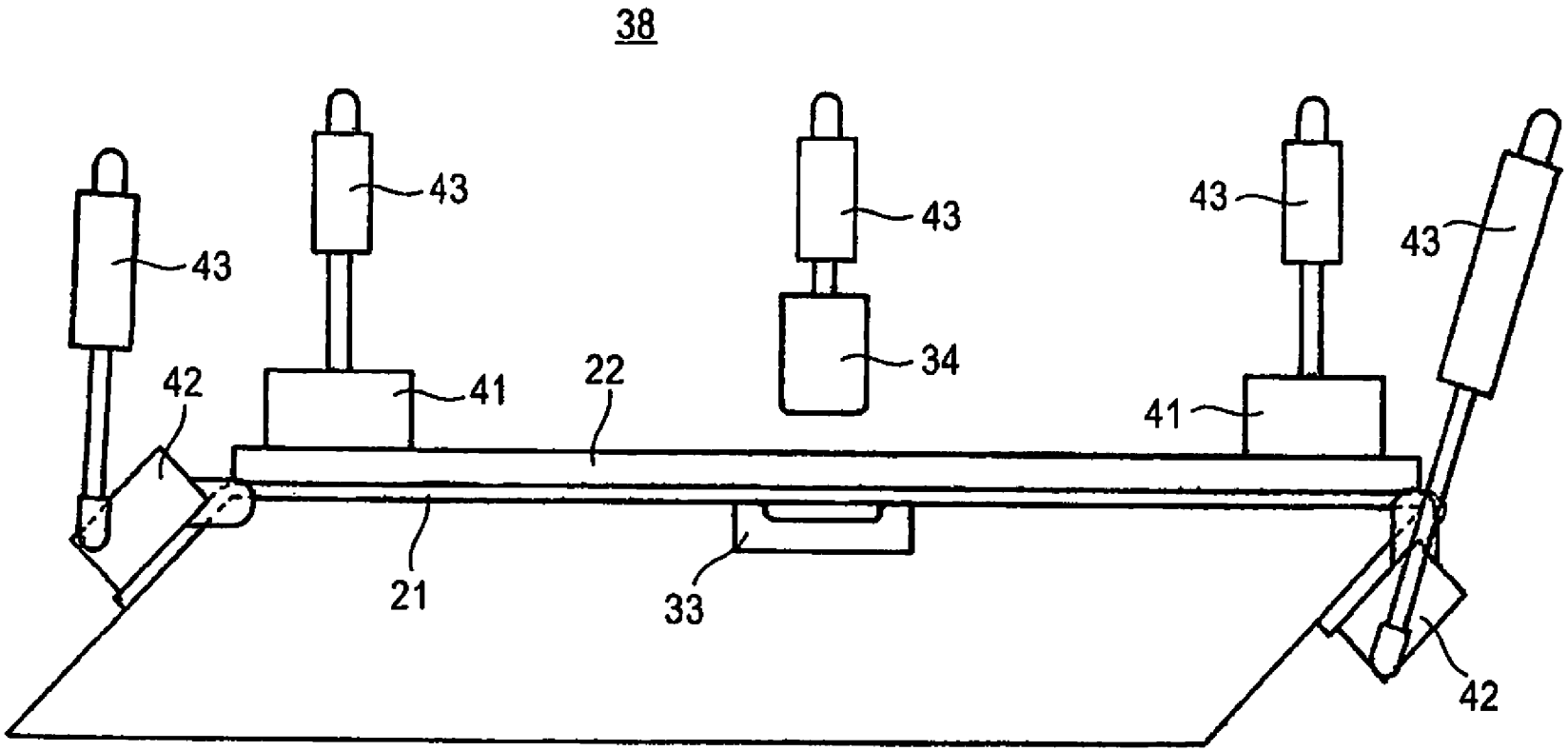
Figure 14:
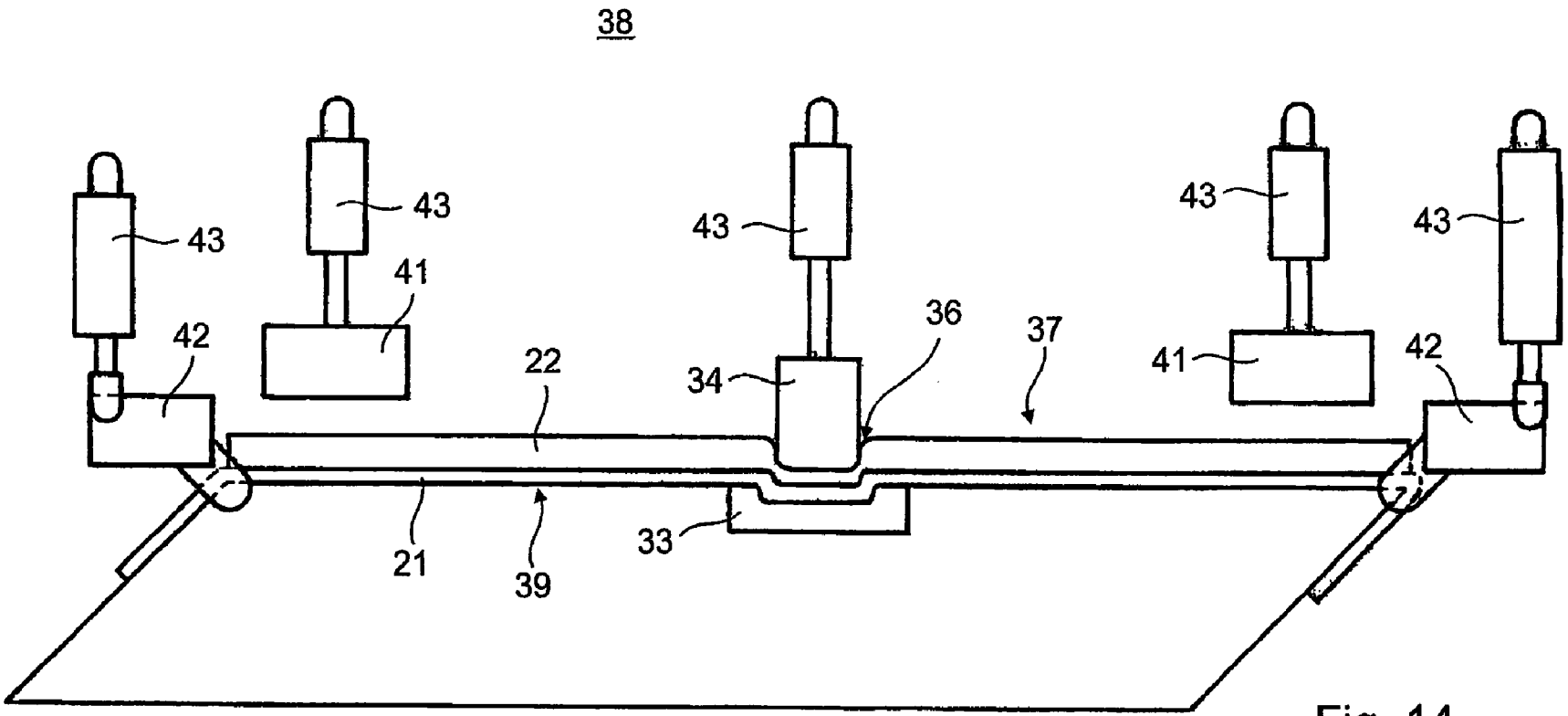

In a first variation of this preferred embodiment, this deformation is pressed, by the use of a die, such as, for example, a lower die 33, as seen in FIGS. 12-14, into the support plate 21. The depression 19 is made in the support plate 21 by the use of an upper die 34 and the lower die 33. In place of such a deformation, the thickness of the support plate 21 can also be reduced.

The depression 19 has a sweep of approximately 0 mm to 1 mm. The width 27 is approximately 3 mm to 8 mm, wherein the depth lies at approximately 0.1 mm to 0.5 mm, and in particular is approximately 0.2 mm to 0.3 mm.

Advantageously, the depression 19 is applied to the support plate 21 prior to the application of the rubber coating 22 to the dimensionally-stable support plate 21 and prior to the application of the resultant printing blanket 14 to the transfer cylinder 03. In another embodiment of the present invention, the depression 19 can be applied to the support plate 21 when the rubber coating 22 has already been applied to the support plate 21.

Figure 10:
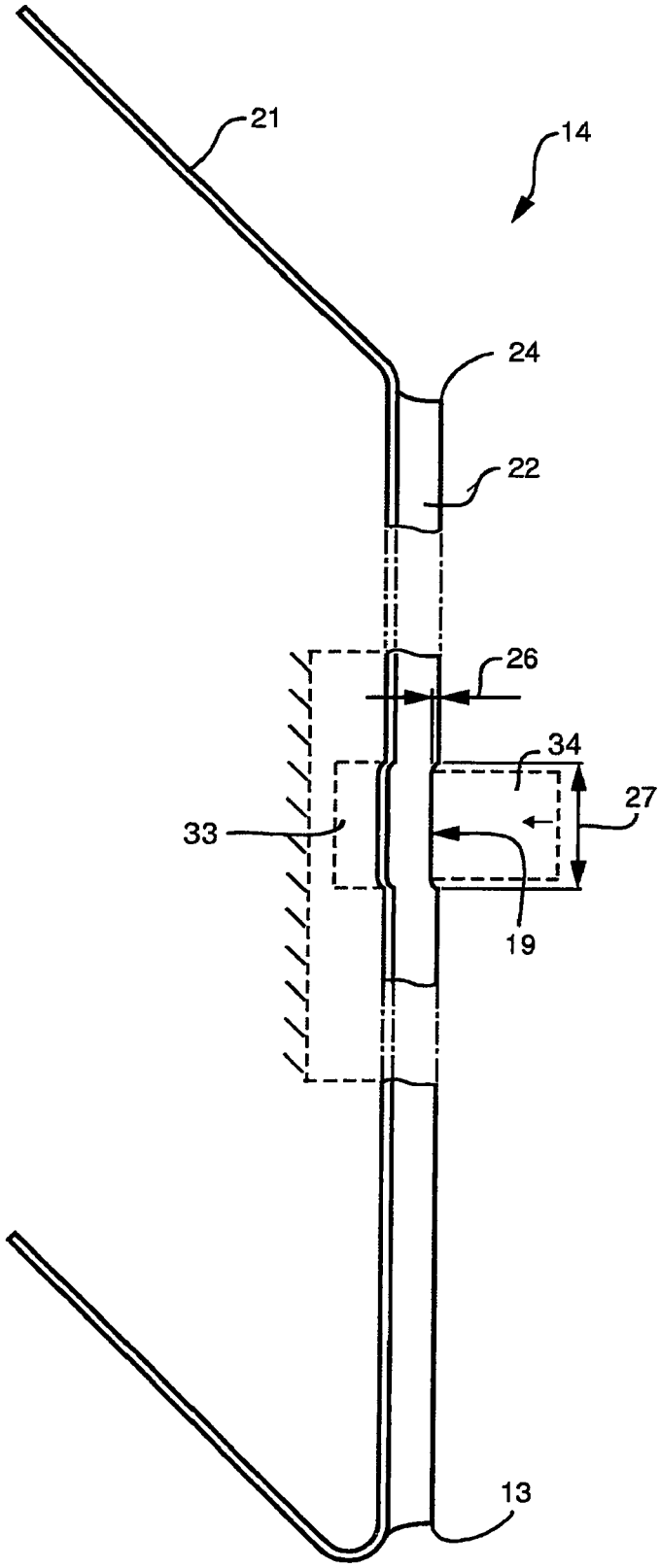

In a further embodiment of the present invention, as represented in FIG. 10, not only do the rubber coating 22 and the support plate 21 have depressions 19, but the transfer cylinder 03 also has a depression 36 in this same area, which cylinder depression 36 has been cut into the barrel of the transfer cylinder 03.

Figure 11:
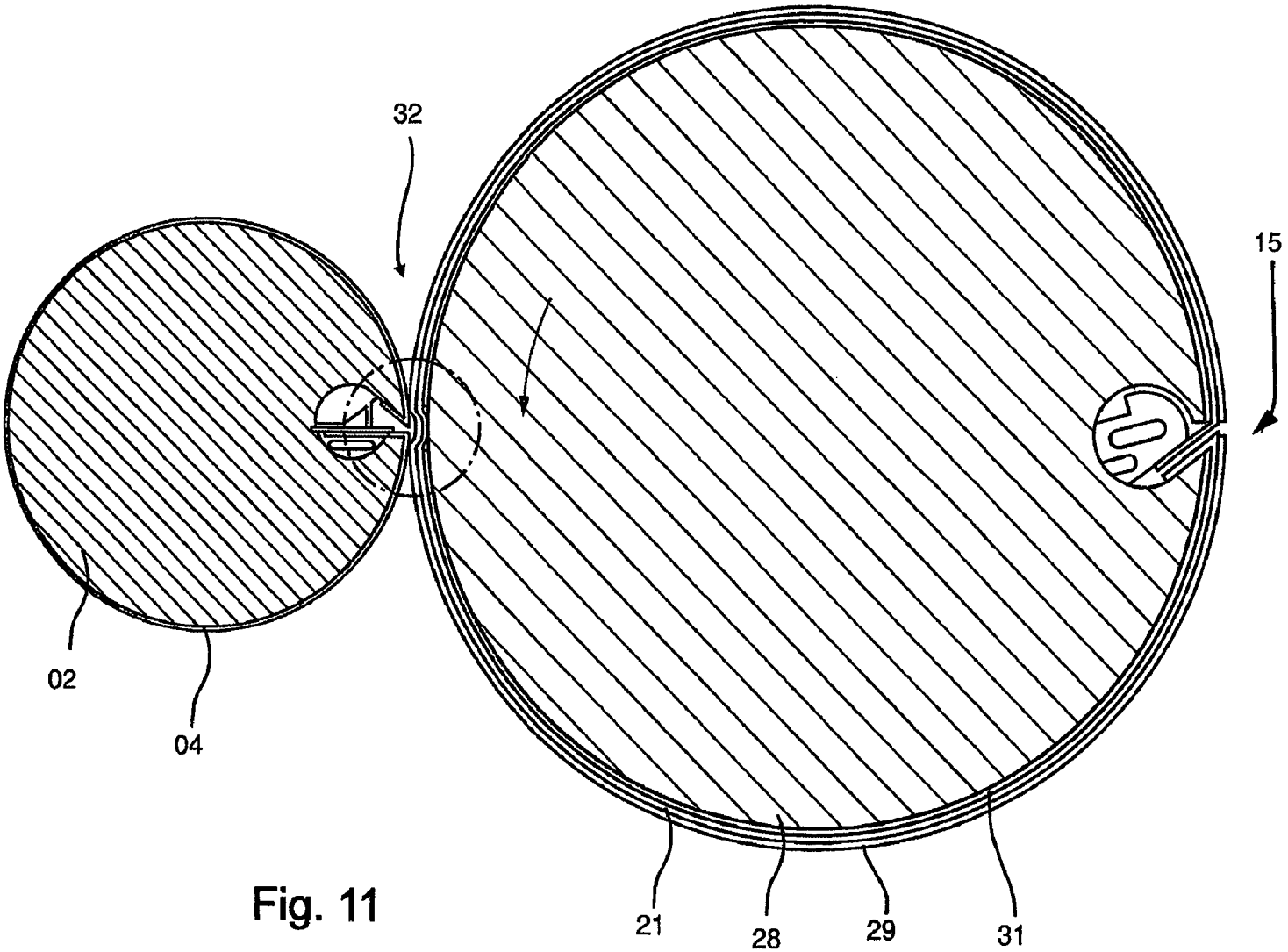

If the transfer cylinder 28 has an underlayer 31, such as, for example, a glued-on foil, the depression 32 is applied to, or between the underlayer 32 and the barrel of the transfer cylinder 28, as seen in FIG. 11. As can be easily seen in FIGS. 9 and 11, the two ends 17 of the printing plate 04 roll off on the depression 19, 32.

The preferred embodiments can also be transferred to transfer cylinders 03, 28 on which two printing blankets 14, 29 are arranged in the axial direction. In this case the depressions 19, 32 are preferably arranged offset, such as, for example, by 180°, in the circumferential direction of the transfer cylinder 03, 28.

A plate cylinder 02 can also work together with the transfer cylinder 03, 28, and wherein, as seen in FIG. 11, a circumference of the transfer cylinder 03, 28 is a whole number multiple of the circumference of the plate cylinder 02. In a preferred embodiment, the circumference of the plate cylinder 02 has one printing plate 04 in the circumferential direction, and four printing plates 04 in the axial direction. A dampening unit can be assigned to the plate cylinder 02.

A preferred production method, as depicted in FIGS. 12 to 14, of the printing blanket will be described in what follows:

Prior to its application to a transfer cylinder 03, which is arranged in a printing press, the dimensionally-stable support plate 21, together with the coating 22 is deformed with the aid of a lower die 33 and an upper die 34 to produce a depression 19.

To this end, the printing blanket unit 37, consisting of the support plate 21 and coating 22, is inserted into a device 38. Essentially this device 38 has a support 39, has at least one, or several, hold-down devices 41, two movable, for example pivotable, support plate end bending strips 42, the upper die 34 and the lower die 33. The hold-down devices 41, the bending strips 42 and the upper die 34 may be for example, each moved by a respective work cylinder 43, for example, a pneumatic cylinder 43.

Initially, with the bending strips 42 open, the printing blanket unit 37 is placed on the support 39 of the device 38 and is fixed in place there by the hold-down devices 41, as seen in FIG. 12. Subsequently, the ends of the support plate 21 are preferably bent by pivoting the bending strips 42, as seen in FIG. 13, the depression 19 is formed in the printing blanket unit 37 by the upper die 34, as seen in FIG. 14.

While preferred embodiments of a printing blanket having a dimensionally stable carrier plate, of methods for producing a printing blanket of this type, and of a printing unit for a printing machine without a dampening unit, in accordance with the present invention, have been set forth fully and completely hereinabove, it will be apparent to one of skill in the art that various changes in, for example, the type of material being printed, the drives for the cylinders, the ink supply assembly and the like could be made without departing from the true spirit and scope of the present invention which is accordingly to be limited only by the appended claims.

What is claimed is:

1. A printing group of a printing press not having a dampening unit, said printing group comprising:

a plate cylinder;

at least first and second waterless planographic printing plates, each having a print image area and being arranged one behind the other in a circumferential direction of said plate cylinder and having first and second sets of adjacent printing plate ends extending longitudinally on said plate cylinder, said adjacent plate ends being located outside of said print image areas of said at least first and second waterless planographic printing plates;

a transfer cylinder cooperating with said at least first and second waterless planographic printing plates on said plate cylinder;

a printing blanket on a circumferential surface of said transfer cylinder and adapted to receive an ink image from said print image area of each said waterless planographic printing plate on said plate cylinder;

a printing blanket end receiving opening on said circumferential surface of said transfer cylinder, said opening being located opposite said a first set of said adjacent printing plate ends of said first and second circumferentially arranged printing plates;

a coating on said printing blanket and having a coating thickness, said coating being adapted to receive a print image from said print image area of each said waterless planographic printing plate;

a depression formed as a groove in said coating on said printing blanket, said groove being located opposite said a second set of said adjacent printing plate ends of said first and second circumferentially arranged printing plates and having a depth of between 5% and 15% of said coating thickness; and a metal support plate supporting said printing blanket, said printing blanket end receiving opening and said printing blanket coating groove preventing said first and second sets of printing plate ends from forming a plate end print image on said coating.

2. The printing group of claim 1 wherein two of said printing blankets are arranged side-by-side in an axial direction of said transfer cylinder.

3. The printing group of claim 1 wherein said depression extends in an axial direction of said transfer cylinder.

4. The printing group of claim 1 further including a coating on said support plate of said printing blanket, said coating constituting a shell face of said transfer cylinder.

5. The printing group of claim 4 wherein said coating includes first and second coating ends and wherein said depression in a groove centered between said first and second coating ends.

6. The printing group of claim 4 wherein said coating is rubber.

7. The printing group of claim 6 wherein said rubber coating is a multi-layer rubber material.

8. The printing group of claim 4 wherein said coating has a ground surface.

9. The printing group of claim 1 further including a multi-layer coating on each said printing plate, said coating including a lower layer and an upper layer.

10. The printing group of claim 9 wherein said lower layer is an ink-absorbing material and said upper layer is an ink-repelling material.

11. The printing group of claim 10 wherein said ink-repelling material includes silicon.

12. The printing group of claim 10 wherein said upper layer is discontinuous.

13. The printing group of claim 9 wherein said upper layer overlies said lower layer in areas of a print image not to be printed.

14. The printing group of claim 1 further including spaced first and second ends of said printing blanket, said depression being formed by a distance between said spaced first and second printing blanket ends.

15. The printing group of claim 14 wherein said depression is parallel to a longitudinal axis of said transfer cylinder.

16. The printing group of claim 1 wherein said depression is a groove formed in said printing blanket.

17. The printing group of claim 1 wherein said depression has a depression width and said printing blanket has a printing blanket length, both in a circumferential diameter of said transfer cylinder, said depression width being 0.1% to 1.0% of said printing blanket length.

18. The printing group of claim 1 wherein said metal support plate is sheet metal.

19. The printing group of claim 18 wherein said metal support plate is steel.

20. The printing group of claim 1 further including an underlayer between said printing blanket and said circumferential surface of said transfer cylinder, said underlayer including an underlayer depression.

21. The printing group of claim 1 further including a plurality of said printing blankets arranged axially side by side on said transfer cylinder.

22. The printing group of claim 1 wherein each said waterless planographic printing plate extends axially the length of said plate cylinder.

23. The printing group of claim 1 wherein a plurality of said waterless planographic printing plates are arranged axially side by side on said plate cylinder.

24. The printing group of claim 23 wherein said plate cylinder includes plate end receiving openings aligned in an axial direction of said plate cylinder.

25. The printing group of claim 1 wherein a size of each said waterless planographic printing plate corresponds to a newspaper page.

26. The printing group of claim 1 further including temperature control means for at least one of said plate cylinder and said transfer cylinder.

27. The printing group of claim 26 wherein said temperature control means is an interior temperature control means.

28. The printing group of claim 27 wherein said interior temperature control means includes heat carrier circulating conduits.

29. The printing group of claim 28 wherein said heat carrier circulating conduits are adapted to receive a fluid.

30. The printing group of claim 26 wherein said temperature control means senses a circumferential speed of said at least one of said plate cylinder and said transfer cylinder.

* * * * *